US010309712B2

(12) United States Patent
Müller et al.

(10) Patent No.: US 10,309,712 B2
(45) Date of Patent: Jun. 4, 2019

(54) COOLING DEVICE

(71) Applicant: B Medical Systems S.a r.l., Hosingen (LU)

(72) Inventors: Josef Müller, Bollendorf (DE); Andreas Hoffmann, Ammeldingen (DE); Ralf Thurmann, Jucken (DE)

(73) Assignee: B. Medical Systems, S.a.r.l., Hosingen (LU)

( * ) Notice: Subject to any disclaimer, the term of this patent is extended or adjusted under 35 U.S.C. 154(b) by 0 days.

(21) Appl. No.: 15/317,273

(22) PCT Filed: Apr. 15, 2015

(86) PCT No.: PCT/EP2015/058207

§ 371 (c)(1),
(2) Date: Dec. 8, 2016

(87) PCT Pub. No.: WO2016/165763

PCT Pub. Date: Oct. 20, 2016

(65) Prior Publication Data

US 2018/0023876 A1 Jan. 25, 2018

(51) Int. Cl.
*F25D 11/00* (2006.01)
*F25B 39/02* (2006.01)
(Continued)

(52) U.S. Cl.
CPC ..... *F25D 11/006* (2013.01); *F25B 39/02* (2013.01); *F25D 3/08* (2013.01); *F25D 11/003* (2013.01);
(Continued)

(58) Field of Classification Search
CPC ..... F25D 11/006; F25D 3/08; F25D 16/00; F25D 11/003
See application file for complete search history.

(56) References Cited

U.S. PATENT DOCUMENTS 2,674,101 A * 4/1954 Calling ..... A01J 9/04 137/59
3,018,638 A 1/1962 Winkler
(Continued)

FOREIGN PATENT DOCUMENTS

DE 102010023564 A1 * 12/2011 ..... F25D 11/006
DE 102010023564 A1 * 12/2011 ..... F25D 11/06
WO 2013091913 A1 6/2013

OTHER PUBLICATIONS

International Search Report and Written Opinion of the International Searching Authority, PCT Application PCT/EP2015/058207, dated Dec. 22, 2015, with English translation, 11 pages.

*Primary Examiner* — Emmanuel E Duke
(74) *Attorney, Agent, or Firm* — Jerold I. Schneider

(57) ABSTRACT

The present invention relates to a cooling device, in particular a freezer, comprising a cooling circuit having a compressor, at least one evaporator, and a condenser; a space for cooling goods that can be closed at its upper surface; and a coolant reservoir at least partially surrounding an upper region of the space for cooling goods, wherein the at least one evaporator is disposed in the coolant reservoir, and wherein the at least one evaporator at least partially surrounds the upper region of the space for cooling goods.

21 Claims, 6 Drawing Sheets

Figure 1:
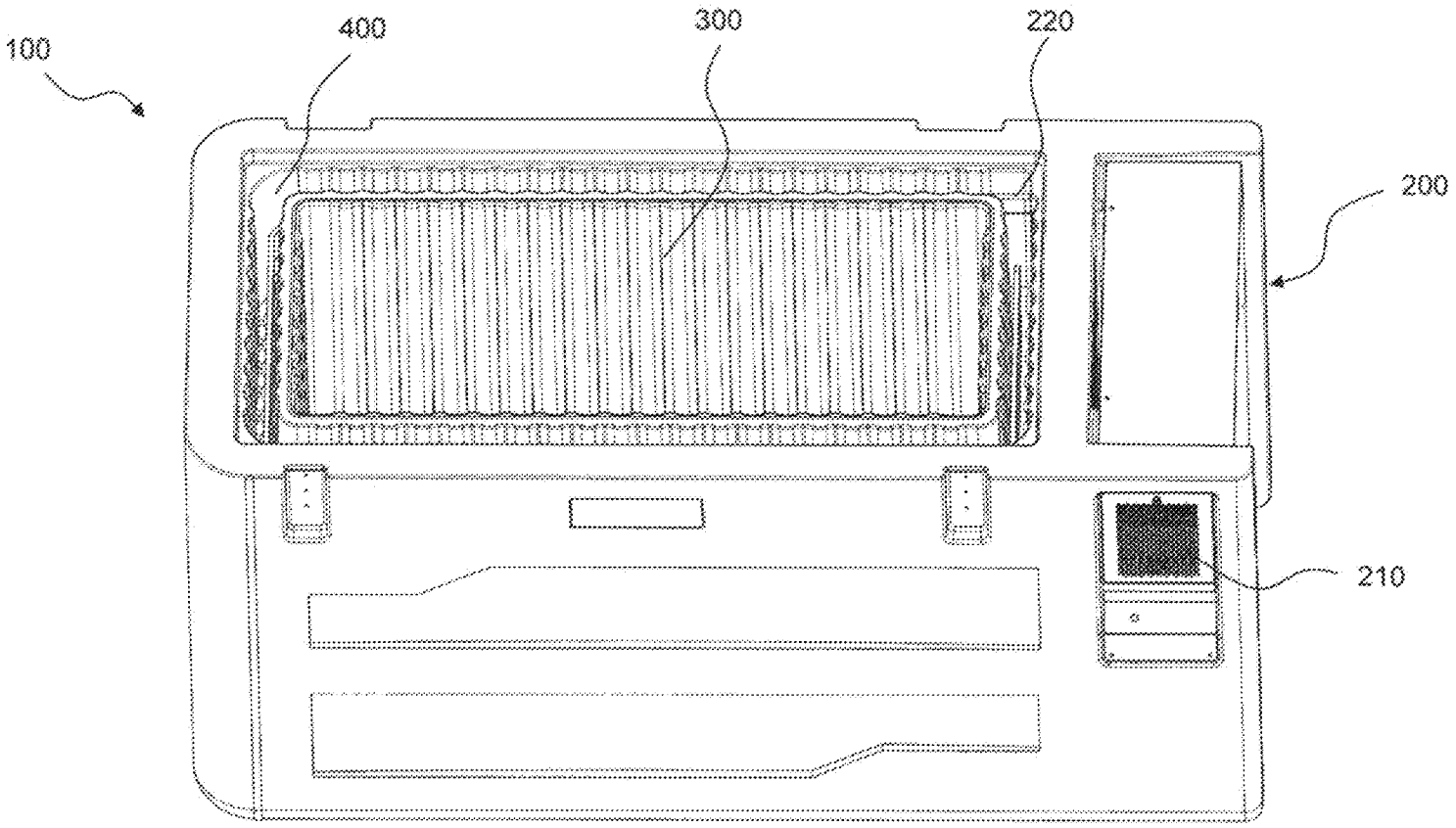

(51) Int. Cl.
*F25D 3/08* (2006.01)
*F25D 16/00* (2006.01)

(52) U.S. Cl.
CPC ..... *F25D 16/00* (2013.01); *F25D 2303/082* (2013.01); *F25D 2303/0831* (2013.01); *F25D 2303/0843* (2013.01)

(56) References Cited

U.S. PATENT DOCUMENTS

| | | | | |
|---|---|---|---|---|
| 5,943,876 | A | 8/1999 | Meyer et al. | |
| 6,578,370 | B1 * | 6/2003 | Andress | A23L 3/364 62/376 |
| 2015/0144206 | A1 * | 5/2015 | Dickinson | B01L 7/02 137/334 |

* cited by examiner

COOLING DEVICE

The invention relates to a cooling device, in particular a freezer or cool box for storing and transport of medical products such as vaccines or blood products.

Such cooling devices can be employed in remote areas, for example in developing countries, where a stable and safe continuous energy supply, for example via a power supply system, cannot be ensured. Just in these areas, where often also extreme climatic conditions prevail, an uninterrupted cold chain for food and in particular medical products, such as for example vaccines or blood products, however is indispensable. In particular, handling and storing of such products under the manufacturer's conditions to be met to achieve the usability and efficacy of the products is often difficult, what is considered to be one of the causes for the extremely poor living conditions of the people living there and significantly contributes to the high mortality rate.

Therefore, the World Health Organization (WHO) has made a catalogue with threshold criteria, which have to be fulfilled by the used cooling equipment for the transport and storage of medical products. Thus, for the transport for short routes thus in particular insulation boxes with ice bags, or so-called freeze packs have established with which the required cooling of the stored substances at least during the short transport can be ensured. For the storage of medical products more stringent requirements arise. So, the cooling temperature in particular for various vaccines and blood products must not be higher than +8° C. and not less than +2° C. Further, even upon failure of the power supply sufficient cooling must be ensured. Thus, in particular electrical cooling apparatus with and without cooling elements, or battery-driven cooling elements are possible. Here, it has been found to be practicable to generate the power required for operation in a photovoltaic manner since the solar insolation in most developing countries is sufficiently high throughout the year.

The failure of power supply, but also the requirement to be able to transport medical products in cold boxes over land, for example requires the production of ice with which the cooling goods can be cooled during the energy-free time or transport, respectively. For example, such power failures regularly occur with a photovoltaically operated cooling device during the solar insolation-free time (e. g. at night or in case of clouds). However, such failures may also occur with mains operation, since in particular in remote areas a stable power supply by no means is certain. Also, with such mains-operated cooling devices the so-called "hold-over" time of generally 20 hours is very low. This is the period within which the internal temperature rises by a maximum of 10° C. at an ambient temperature of 32° C.

In order to effectively freeze water often a temperature is required that is well below under 0° C. to ensure a sufficient cooling of the water, and thus a fast ice formation. For example, there are known cooling devices having a freezing room to produce ice bags or freeze packs in addition to a cooling space for the products to be stored. The ice bags or freeze packs may be used to fill in the energy-free time.

To freeze the water and/or the ice bags a cooling circuit can be used. Due to the limited availability of electric energy it is required that the freezing process is performed with a minimum expenditure of energy and time. Since the cooling devices are to be transportable, moreover their handiness must be ensured. For example, external dimension and weight should be minimized.

Thus, it is an object of the present invention to provide a cooling device providing a reduced expenditure of energy and time for a freezing process and at the same time complies with the prescribed criteria and targets. Moreover, it is an object of the present invention to provide a cooling device having a compact, reliable and simple construction.

The object of the invention is solved by the subject matter of the independent claim. Preferred optional embodiments and specific aspects of the invention result from the dependent claims, the drawings, and the following description.

In accordance with embodiments of the present disclosure there is suggested a cooling device, in particular a freezer. The cooling device comprises a cooling circuit having a compressor, at least one evaporator and a condenser; a space for cooling goods that can be closed at its upper surface; and a coolant reservoir at least partially surrounding an upper region of the space for cooling goods, wherein the at least one evaporator is disposed in the coolant reservoir, and wherein the at least one evaporator at least partially surrounds the upper region of the space for cooling goods.

In accordance with the embodiments described in the following an expenditure of energy and time for a freezing process can be reduced and at the same time the prescribed criteria and targets can be complied with. Moreover, the cooling device according to the invention has a compact, reliable, and simple construction. In particular, by disposing the at least one evaporator of the cooling circuit in the coolant reservoir, i.e. in the cooling liquid, for example in the water, a good energy flow between the cooling liquid and the at least one evaporator can be ensured which allows a rapid freezing of the cooling liquid at a reduced expenditure of energy. In other words, in accordance with embodiments it is possible to quickly and efficiently produce ice. The ice can also be referred to as "icelining". Moreover, by providing the coolant reservoir no additional cooling space for freezing or storing ice bags or freeze packs is needed whereby the cooling device can be made compact and simple.

In accordance with some embodiments that can be combined with other embodiments described here the at least one evaporator is disposed in a lower region of the coolant reservoir. For example, the at least one evaporator is designed to freeze coolant, in particular water, starting from a lower region of the coolant reservoir towards an upper region of the coolant reservoir. In this way, the coolant can expand without resistance in the freezing process, whereby a damage of the coolant reservoir in the freezing process by the increase in volume can be prevented. For example, the coolant reservoir can be an upwardly open coolant reservoir, so that the coolant can upwardly expand in freezing without resistance. The upwardly open coolant reservoir can be closed by a lid for example the same lid with which also the upper surface of the space for cooling goods can be closed. Alternatively, the coolant reservoir may also be formed of a partially closed container made in one piece in which the at least one evaporator is disposed.

In some implementations the at least one evaporator is formed as a tubular evaporator. For example, the at least one evaporator can comprise at least one loop and in particular three or more loops. In this way, the at least one evaporator can be disposed in the coolant reservoir in a simple manner and with little effort, so that the at least one evaporator is looped around the region of the space for cooling goods. By the tubular evaporator that can have one or more loops the coolant can be uniformly cooled and frozen in the coolant reservoir. It is also conceivable that the evaporator formed as a tubular evaporator is disposed in the coolant reservoir such that it has an inclination.

In accordance with some embodiments that can be combined with other embodiments described here the coolant reservoir at least partially or even completely surrounds the upper region, and in particular an upper circumferential region of the space for cooling goods. In this way, the space for cooling goods or the cooling goods, respectively, can be cooled uniformly and from all sides, so that a temperature distribution within the space for cooling goods is homogenous. This is of particular advantage for storing medical products, since for example the whole vaccine or all of the blood conserves are substantially exposed to the same temperature.

In accordance with some embodiments that can be combined with other embodiments described here the upper region of the space for cooling goods, that is at least partially or completely surrounded by the coolant reservoir, corresponds to 10% to 90% of a height of the space for cooling goods, and in particular 40% to 60% of the height of the space for cooling goods. In this way, on the one hand a sufficient cooling of the space for cooling goods can be ensured and on the other hand the weight of the cooling device can be reduced, since the space for cooling goods is not completely, i.e. not over its entire height, surrounded by the coolant reservoir or embedded or immersed therein.

In accordance with some embodiments that can be combined with other embodiments described here the coolant reservoir is upwardly open or closed. In some implementations the coolant reservoir has a U-shaped cross section. For example, the U-shaped cross section can be upwardly open, so that the coolant can upwardly expand during freezing without any resistance.

In accordance with some embodiments that can be combined with other embodiments described here the coolant reservoir comprises external walls that are formed at least partially wavy or corrugated. For example, the external walls of the coolant reservoir may be formed wavy or corrugated in a direction perpendicular to the height direction of the space for cooling goods. In this way, the cooling device, and in particular the coolant reservoir, can be provided with an increased stability.

In some embodiments that can be combined with other embodiments described here the cooling device comprises a cooling space having four cooling space sidewalls, a cooling space base and a lid designed to close the space for cooling goods at its upper surface. For example, a receiving space or cavity can be formed between the four cooling space sidewalls of the cooling space and the external walls of the space for cooling goods, wherein the coolant reservoir can be disposed in said receiving space. The receiving space can at least partially be filled with air and/or with an insulation material, for example an insulating foam. By the insulation material a thermal energy flow between the coolant reservoir and the space for cooling goods can be adjusted or influenced.

Typically, the coolant reservoir is spaced from the four cooling space sidewalls of the cooling space and/or the external walls of the space for cooling goods. By providing a distance between the space for cooling goods and the coolant reservoir a predetermined thermal insulation between the space for cooling goods and the coolant reservoir can be provided. In some embodiments the distance is selected such that a predetermined heat exchange between the space for cooling goods and the coolant reservoir can occur. In this way, it can for example be prevented that the interior and the walls of the space for cooling goods fall to a temperature below 2° C.

In accordance with some embodiments that can be combined with other embodiments described here the cooling device is designed to provide a temperature within a particular range of especially +2 to +8° C. in the space for cooling goods, for example if an electric primary cooling circuit of the cooling device is not functional due to a power interruption (e.g. at night, in case of clouds or power failure). For example, this can be done by a suitable design of the coolant circuit, the volume of the coolant reservoir, the height of the coolant reservoir, the type and amount of the insulation material in the receiving space, the distance between the space for cooling goods and the coolant reservoir and/or a combination of said measures. Optionally, further a heating device may be provided that is designed to supply heat to the space for cooling goods. In this way, for example it can be prevented that the interior of the space for cooling goods falls to a temperature of below 2° C.

Typically, the cooling device is a freezer for storing and transport of medical products, such as for example vaccines or blood products. Such freezers can be advantageously employed in remote areas, for example in developing countries, where a stable and safe continuous energy supply, for example via a power supply system, cannot be ensured.

Figure 2:
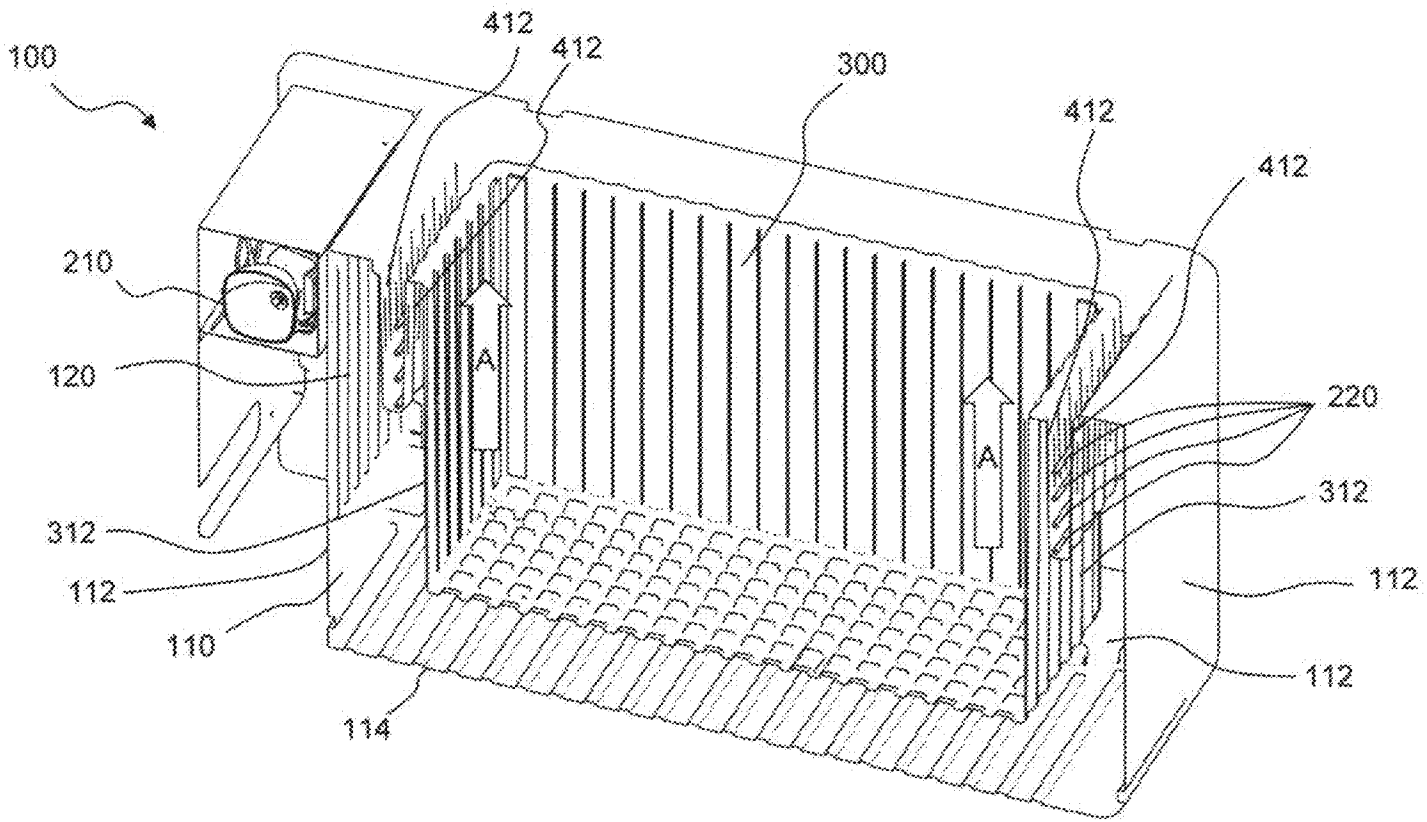
Figure 3:
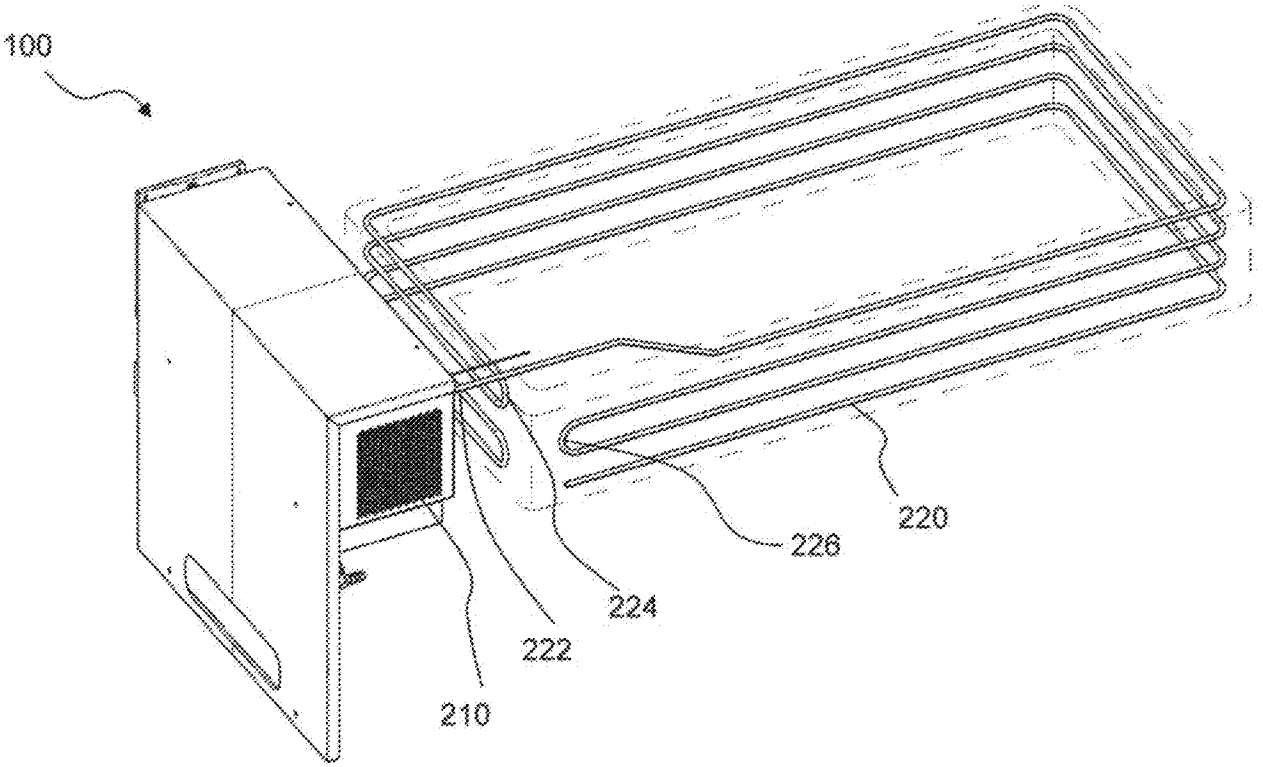
Figure 4:
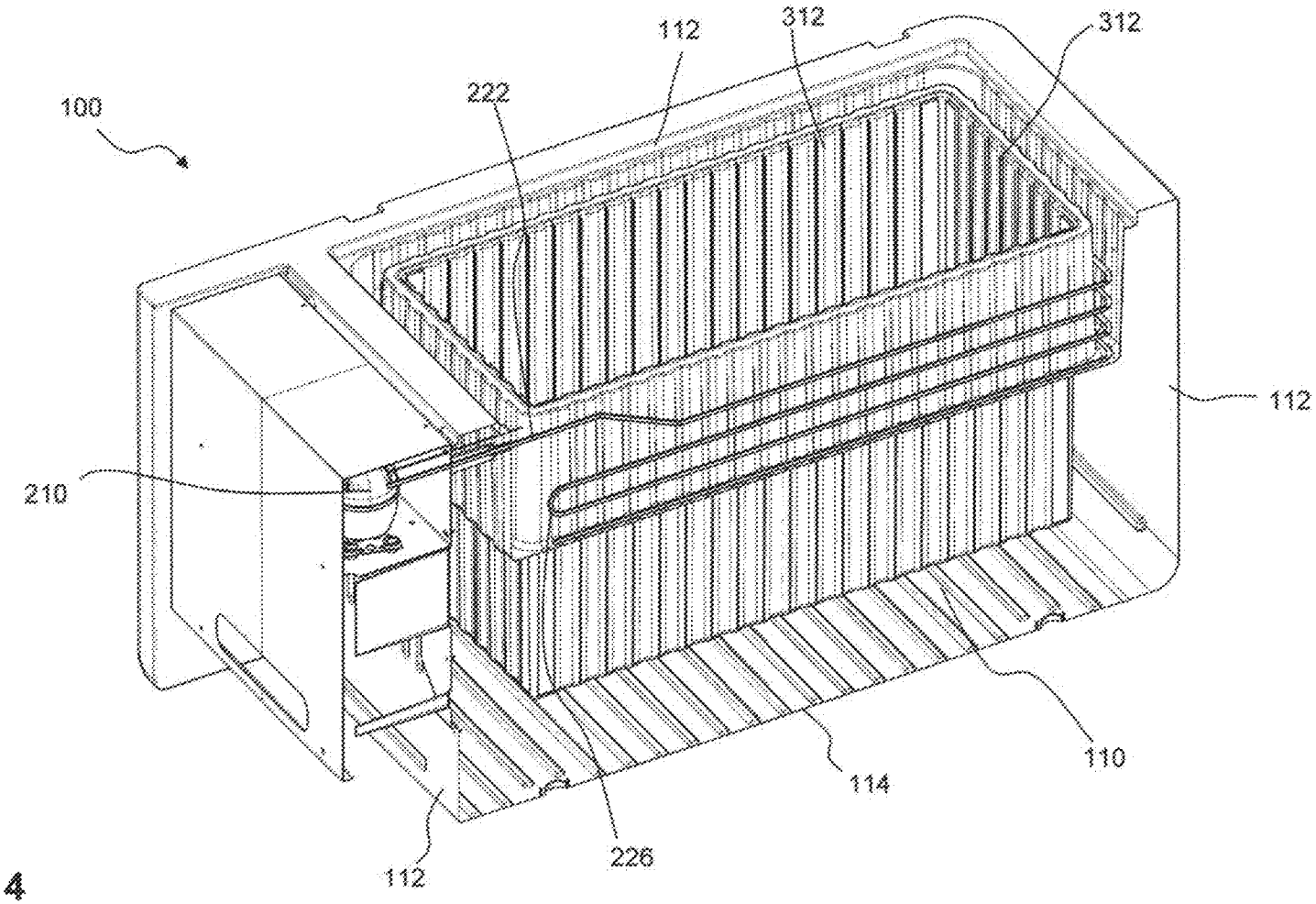
Figure 5:
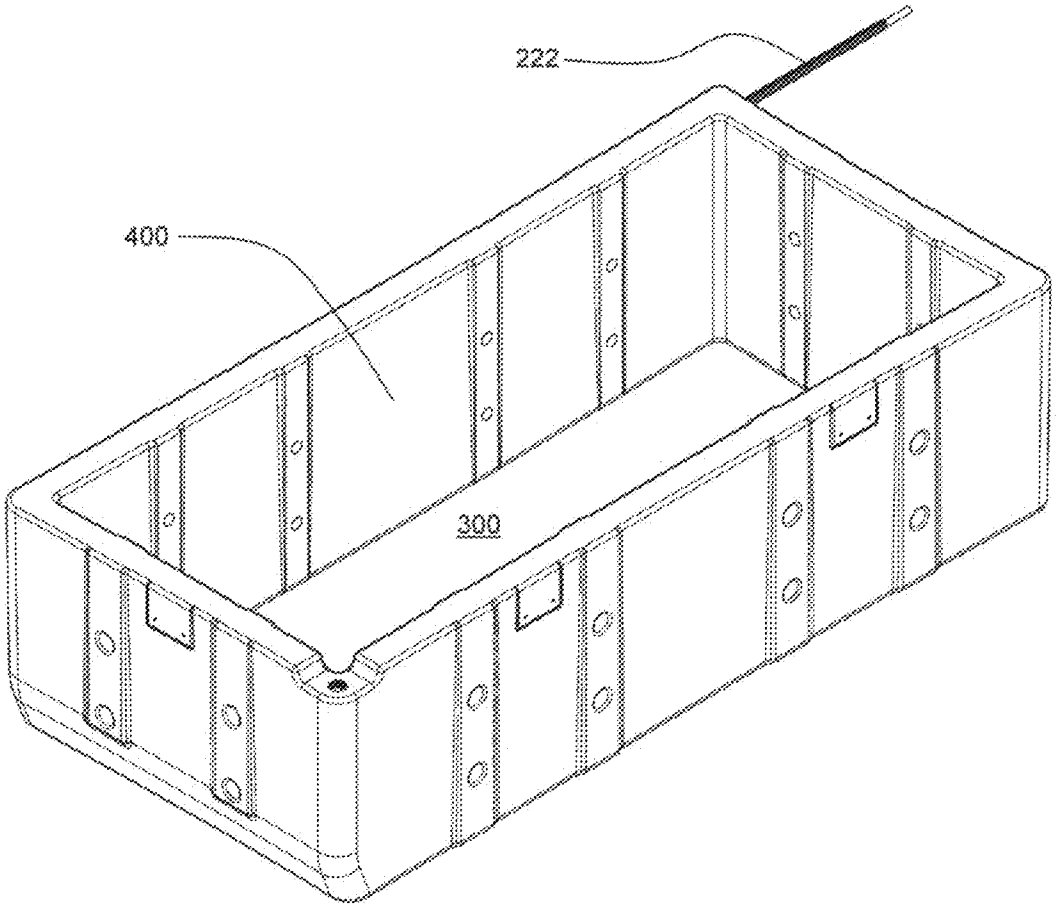
Figure 6:
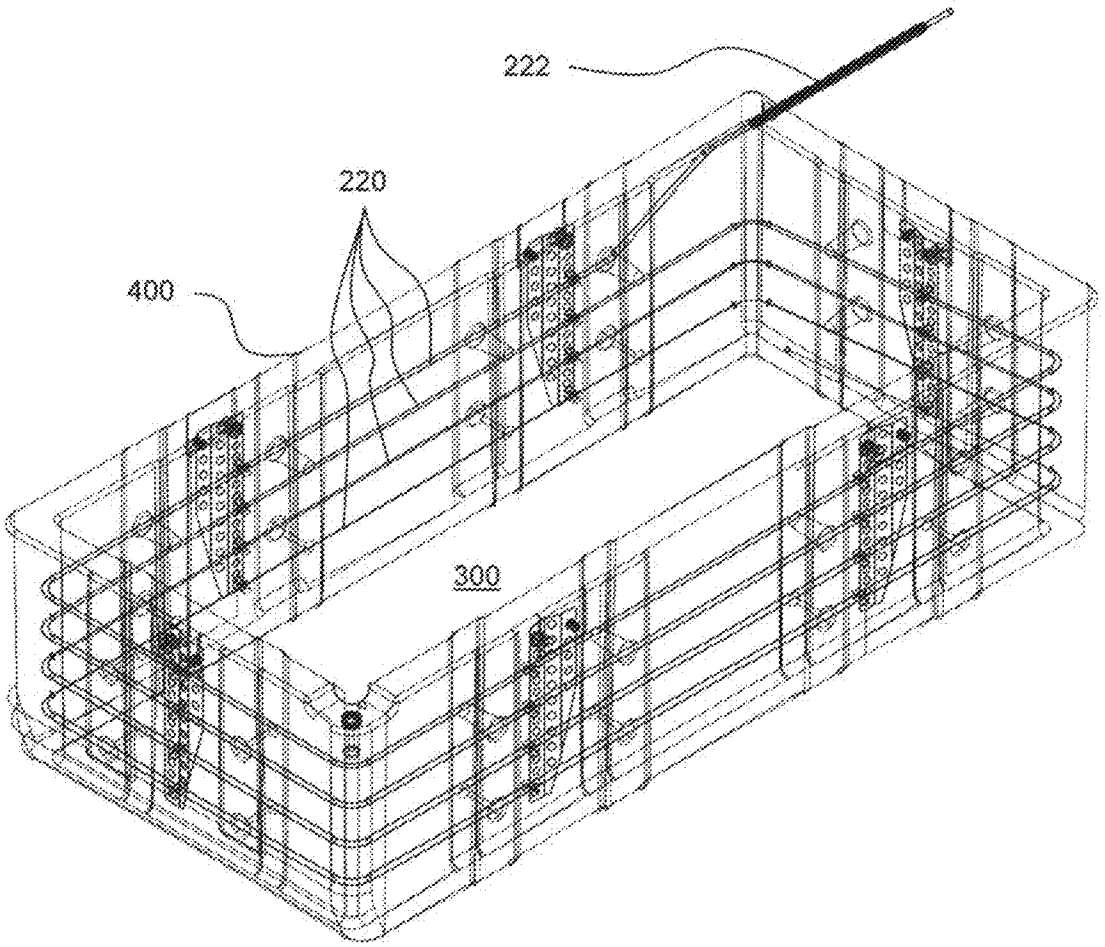

Examples of the invention are illustrated in the drawings and are described in detail in the following. Here:

FIG. 1 shows a schematic illustration of a cooling device in accordance with embodiments of the present disclosure, FIG. 2 shows a schematic sectional view of the cooling device of FIG. 1 in accordance with embodiments of the present disclosure, FIG. 3 shows a schematic illustration of a cooling circuit of a cooling device in accordance with embodiments of the disclosure, FIG. 4 shows a schematic sectional view of a cooling device having a tubular evaporator with loops in accordance with embodiments of the present disclosure, FIG. 5 shows a schematic illustration of a coolant reservoir, FIG. 6 shows a transparent view of the coolant reservoir shown in FIG. 5.

In the following, unless stated otherwise, the same reference symbols are used for identical and equivalent elements.

FIG. 1 shows a schematic illustration of a cooling device 100.

The cooling device 100 comprises a cooling circuit 200 having a compressor 210, at least one evaporator 220, and a condenser (not shown), a space for cooling goods 300 that can be closed at its upper surface, and a coolant reservoir 400 that at least partially surrounds an upper region of the space for cooling goods 300. The evaporator 220 is disposed in the coolant reservoir 400 and at least partially surrounds the upper region of the space for cooling goods 300. Typically, the coolant reservoir 400 is a container or a basin suitable to receive a coolant or cooling liquid (not shown), for example water. The space for cooling goods 300 is provided and designed to receive and store cooling goods, for example medical products.

A failure of power supply as is regularly occurring with a photovoltaically operated cooling device during the solar insolation-free time, e.g. at night or in case of clouds, but also the requirement to be able to transport medical products in the cooling device over land, for example requires the production of ice with which the cooling goods in the space for cooling goods 300 can be cooled during the energy-free time or transport, respectively.

By disposing the at least one evaporator 220 of the cooling circuit directly in the coolant reservoir 400, i.e. in the cooling liquid, for example water, a good energy flow between the coolant and the at least one evaporator 220 can be ensured, which allows a rapid freezing of the coolant at reduced energy expenditure, see also FIG. 5 and FIG. 6. In other words, according to the invention ice can quickly and efficiently be produced. The ice can also be referred to as "icelining".

Moreover, by providing the coolant reservoir 400 no additional cooling space for freezing or storing ice bags or freeze packs is needed, whereby the cooling device 100 can be produced in a compact, simple, and inexpensive manner. Also, the ice bags or freeze packs themselves are not needed which further simplifies a construction of the cooling device 100 and reduces production costs, in particular since less moveable parts are present.

The coolant reservoir 400 and/or the at least one evaporator 220 do(es) not extend beyond the upper surface or the upper edge of the cooling space 300. In this way, the cooling device 100 can be built compactly. In particular, the height of the cooling device 100 can be minimized, since the at least one evaporator 220 surrounds the upper region of the space for cooling goods 300 and thus, is not disposed above or below the space for cooling goods 300.

The compressor 210 and/or the condenser may be disposed on one side of the space for cooling goods 300. This allows a compact assembly. In particular, by the lateral arrangement of the compressor 210 and/or the condenser the total height of the cooling device 100 can be further reduced and the influence of the unavoidable heat generation of the cooling device on the cooling space is minimized.

Here, the cooling circuit is designed as a refrigerating machine that uses a thermodynamic cycle. In such a thermodynamic cycle by supplying external energy, for example by the compressor, heat below the ambient temperature, for example of the coolant to be frozen, can be absorbed at one point and evolved at a higher temperature at another point, for example at the condenser.

The space for cooling goods 300 according to the embodiments described here has the upper surface and a lower surface. The terms "upper surface" and "lower surface" relate to opposite sides of the space for cooling goods 300 or the cooling device 100, respectively. The upper surface and the lower surface are connected by sidewalls. The lower surface may also be referred to as "base". The upper surface has an opening through which the space for cooling goods 300 is accessible from the outside. The opening can be closed, and in particular can be closed by a lid (not shown).

FIG. 2 shows a schematic sectional view of the cooling device 100 of FIG. 1.

The evaporator 220 is designed to freeze the coolant starting from a lower region of the coolant reservoir 400 towards an upper region of the coolant reservoir 400. In other words, the coolant freezes from the lower surface of the space for cooling goods 300 or the cooling device 100, respectively, towards the upper surface of the space for cooling goods 300 or the cooling device 100, respectively, indicated by the arrow A. In this way, the coolant can expand without any resistance during the freezing process, whereby damage of the coolant reservoir 400 or the cooling device 100, respectively, is prevented.

The evaporator 220 may be disposed in a lower region of the coolant reservoir 400 to freeze the coolant starting from the lower region of the coolant reservoir 400 towards the upper region of the coolant reservoir 400. As can be seen for example in FIG. 2, the evaporator 220 is disposed in the lower two thirds or a lower half of the coolant reservoir 400. Typically, the at least one evaporator 220 is disposed in the coolant reservoir 400 such that the at least one evaporator 220 is at least partially, and in particular completely, surrounded by the coolant or immersed into the coolant, respectively.

The coolant reservoir 400 may have a volume that can take up a predetermined amount of the coolant. Here, less than 90%, and in particular between 50% and 90% of the volume of the coolant reservoir 400 can be filled with the coolant. In other words, the coolant reservoir 400 can be filled with the coolant up to a certain height that is smaller than the total height of the coolant reservoir 400. In this way, during freezing the coolant can expand upwardly without escaping from the coolant reservoir 400.

As can be seen in particular in FIG. 5 and FIG. 6 the coolant reservoir 400 is formed upwardly open. However, it is also conceivable to form the coolant reservoir 400 upwardly closed. If the coolant reservoir 400 is upwardly closed, in accordance with some implementations less than 90%, and in particular between 50% and 90% of the volume of the coolant reservoir 400 can be filled with the coolant, whereby damage of the coolant reservoir 400 or the cooling device 100, respectively, can be prevented.

The coolant reservoir 400 has a U-shaped cross section, as is exemplarily shown in FIG. 2. The U-shaped cross section is upwardly open, so that the coolant during freezing can expand upwardly without any resistance, whereby damage of the coolant reservoir 400 or the cooling device 100, respectively, is prevented. Typically, the upwardly open coolant reservoir 400 can be closed by a lid (not shown), and in particular by the same lid that also closes the upper surface of the space for cooling goods 300.

The coolant may be water. However, the present disclosure is not limited to the use of water, and any other coolant suitable for the present purpose or any suitable cooling liquid can be used.

The coolant reservoir 400 comprises external walls 412 that are formed wavy or corrugated in a direction substantially perpendicular to the height extension of the space for cooling goods 300, as is illustrated in the example of FIG. 2. In this way, the cooling device 100, and in particular the coolant reservoir 400 can be provided with an increased stability.

The cooling device 100 comprises a cooling space 110 having four cooling space sidewalls 112, a cooling space base 114, and a closable lid (not shown) designed to close the space for cooling goods 300 at its upper surface. The space for cooling goods 300 and the coolant reservoir 400 are disposed in the cooling space 110 or inserted into the cooling space 110. Typically, the upper surface of the space for cooling goods 300 and the upwardly open coolant reservoir 400 can be closed by the same lid. In this way, the cooling device 100 can have a simple construction.

Between the four cooling space sidewalls 112 of the cooling space 110 and the external walls 312 of the space for cooling goods 300 there is formed a receiving space 120 or cavity. The coolant reservoir 400 is disposed in said receiving space 120. The receiving space 120 is at least partially filled with air, as shown in FIG. 2, and/or an insulation material (not shown), for example an insulating foam. The insulation material thermally insulates the space for cooling goods 300 from the environment of the cooling device 100 or outside world, respectively.

Typically, the coolant reservoir 400 is spaced from the four cooling space sidewalls 112 of the cooling space 110 and/or the external walls 312 of the space for cooling goods 300. By providing a distance between the space for cooling goods 300 and the coolant reservoir 400 a predetermined thermal insulation between the space for cooling goods 300 and the coolant reservoir 400 is achieved. Here, the distance is selected such that a predetermined heat exchange between the space for cooling goods 300 and the coolant reservoir 400 occurs. In this way, it is prevented that the interior of the space for cooling goods 300 falls to a temperature below 2° C. The region between the space for cooling goods 300 and the coolant reservoir 400 can at least partially be filled with the insulation material, for example the insulating foam.

The cooling space 110, the coolant reservoir 400, and/or the space for cooling goods 300 preferably consist(s) of a plastic, for example of polyethylene or polypropylene. Of course, the respective parts may also consist of another suitable material, in particular metal. The cooling space 110, the coolant reservoir 400, and the space for cooling goods 300 in the present example are integrally formed. However, the cooling space 110, the coolant reservoir 400, and the space for cooling goods 300 may also have a multi-part design.

The cooling device 100 in the space for cooling goods 300 allows to provide a temperature in a particular range of for example +2 to +8° C., for example if the electric primary cooling circuit of the cooling device 100 is not functional due to a power interruption, for example at night or in case of a cloudy sky or power failure. This is done by a suitable design of the coolant circuit, the volume of the coolant reservoir 400, the height of the coolant reservoir 400, the type and amount of the insulation material in the receiving space 120, the distance between the space for cooling goods 300 and the coolant reservoir 400, and/or a combination of said measures. Optionally, further a heating device (not shown) can be provided that is designed to supply heat to the space for cooling goods 300. In this way, for example it can be prevented that the interior of the space for cooling goods 300 falls to a temperature below 2° C. For example, such a heating device can be battery-powered, so that the heating device also functions in case of a lacking external energy source.

FIG. 3 shows a schematic illustration of the cooling circuit of the cooling device 100. FIG. 4 shows a schematic sectional view of the cooling device 100 having the evaporator 220 with loops in accordance with embodiments of the present disclosure.

The evaporator 220 is formed as a tubular evaporator and extends at least partially in a circumferential direction of the space for cooling goods 300, so that the evaporator at least partially surrounds the upper region of the space for cooling goods 300, and in particular an upper circumferential region of the space for cooling goods 300.

Here, the evaporator 220 comprises at least one loop, and in accordance with the described example three loops. In this way, the at least one evaporator 220 can be disposed in the coolant reservoir 400 in a simple manner and with little effort, so that the evaporator 220 is looped around the upper region of the space for cooling goods 300. By the loop-shaped tubular evaporator the coolant can uniformly be cooled and frozen in the coolant reservoir 400.

As is shown in the example of FIGS. 3 and 4, the evaporator 220 has a tube 222 that starting from the compressor 210 at least partially extends around a circumferential region of the space for cooling goods 300 and then, following a first (perpendicular) bend 224 by about 180° goes back towards the compressor 210. Said path forms a first loop. The evaporator 220 has a second (perpendicular) bend 226 by about 180° and thus, forms a second loop etc. In the described example the evaporator 230 has three loops, as shown in FIGS. 3 and 4. However, an evaporator having less or more loops is also conceivable.

Moreover, in FIG. 5 and FIG. 6 an alternative embodiment of an evaporator 220 is illustrated. The evaporator 220 has a tube 222 that starting from the (not illustrated) compressor 210 extends around a circumferential region of the space for cooling goods 300. Here, the tube extends with a slight inclination of about 5° to 15°.

Irrespective of the actual design of the evaporator 220 the coolant reservoir 400 completely surrounds the upper region of the space for cooling goods 300, and in particular the upper circumferential region of the space for cooling goods 300. In this way, the space for cooling goods 300 is cooled uniformly and from all sides, so that the temperature distribution within the space for cooling goods 300 is homogenous. This is of particular advantage for storing medical products, since the stored articles, for example the vaccine or blood products, are substantially exposed to the same temperature.

The upper region of the space for cooling goods 300 that is at least partially or completely surrounded by the coolant reservoir 400 corresponds to 10% to 90% of the height of the space for cooling goods 300, and in particular 40% to 60% of the height of the space for cooling goods 300. Therefore, on the one hand sufficient cooling of the space for cooling goods 300 is ensured, and on the other hand the weight of the cooling device 100 is reduced, since the space for cooling goods 300 is not completely, i.e. over its total height, surrounded by the coolant reservoir 400 or embedded or immersed into it.

In the example the cooling device 100 is formed as a freezer for storing and transport of medical products, for example vaccines or blood products. Such freezers may advantageously be employed in remote areas, for examples in developing countries, where a stable and safe continuous energy supply, for example via a power supply system, cannot be ensured.

The present invention provides a cooling device in which at least one evaporator is directly disposed in a coolant reservoir or in the coolant, respectively. By disposing the evaporator of the cooling circuit in the coolant reservoir, i.e. in the coolant, for example water, a good energy flow between the coolant and the evaporator can be ensured which allows a rapid freezing of the coolant, for example in less than 1 hour at reduced energy expenditure. Moreover, by providing the coolant reservoir no additional cooling space for freezing or storing ice bags or freeze packs is needed, whereby the cooling device can be formed compact and simple. Moreover, production costs can be reduced, since no such separate ice bags or freeze packs are needed and the cooling device can be produced in a simple and inexpensive manner.

The invention claimed is:

1. A cooling device comprising:

a cooling circuit having a compressor, at least one evaporator, and a condenser;

a space for cooling goods having an upper surface at which the space for cooling goods can be closed; and a coolant reservoir at least partially surrounding an upper region of the space for cooling goods, the coolant reservoir being spaced from the space for cooling goods such that a predetermined thermal insulation is provided between the space for cooling goods and the coolant reservoir, wherein the at least one evaporator is disposed in the coolant reservoir such that in use the at least one evaporator is disposed in a cooling liquid in the coolant reservoir, wherein the evaporator is designed to freeze a coolant in the coolant reservoir to form an ice lining, wherein the at least one evaporator at least partially surrounds the upper region of the space for cooling goods; and wherein the cooling device is a cooling device selected from a cooling device for storing medical products and a cooling device for transport of medical products.

2. The cooling device of claim 1, wherein the evaporator is disposed in a lower region of the coolant reservoir.

3. The cooling device of claim 1, wherein the evaporator is a tubular evaporator.

4. The cooling device of claim 3, wherein the evaporator is selected from an evaporator which comprises at least one loop and an evaporator which comprises three or more loops.

5. The cooling device of claim 1, wherein the evaporator is designed to freeze a coolant comprising water in the coolant reservoir.

6. The cooling device of claim 5, wherein the evaporator is arranged to freeze the coolant starting from a lower region of the coolant reservoir towards an upper region of the coolant reservoir.

7. The cooling device of claim 1, wherein the coolant reservoir completely surrounds an upper circumferential region of the space for cooling goods.

8. The cooling device of claim 1, wherein the upper region of the space for cooling goods that is at least partially surrounded by the coolant reservoir corresponds to 10% to 90% of a height of the space for cooling goods.

9. The cooling device of claim 1, wherein the coolant reservoir is an upwardly open coolant reservoir.

10. The cooling device of claim 1, wherein the coolant reservoir has a U-shaped cross section.

11. The cooling device of claim 1, wherein the coolant reservoir comprises external walls that are formed at least partially wavy.

12. The cooling device of claim 1, further comprising a cooling space having four cooling space sidewalls, a cooling space base and a lid that is designed to close the space for cooling goods at the upper surface of the space for cooling goods.

13. The cooling device of claim 12, wherein between the four cooling space sidewalls of the cooling space and external walls of the space for cooling goods a receiving space is formed, and wherein the coolant reservoir is disposed in the receiving space.

14. The cooling device of claim 13, wherein the coolant reservoir is spaced from the four cooling space sidewalls of the cooling space and the external walls of the space for cooling goods.

15. The cooling device of claim 1, wherein the cooling device is designed to provide a temperature in a range of about +2 to about +8° C. in the space for cooling goods.

16. The cooling device of claim 1, wherein the space for cooling goods is an air-filled space for cooling goods.

17. A cooling device, wherein the cooling device is solar powered, wherein the cooling device is selected from a cooling device for storing medical products and a cooling device for transport of medical products selected from vaccines and blood products which is configured to maintain a temperature in the range of about +2 to about +8° C. in a space for cooling goods, wherein the cooling device comprises:

a cooling circuit comprising a compressor, at least one evaporator and a condenser;

the space for cooling goods having an upper surface at which the space for cooling goods can be closed; and a coolant reservoir at least partially surrounding an upper region of the space for cooling goods, the coolant reservoir being spaced from the space for cooling goods such that a predetermined thermal insulation is provided between the space for cooling goods and the coolant reservoir;

wherein the at least one evaporator is arranged to freeze a water coolant in the coolant reservoir to form an ice lining;

wherein the at least one evaporator is disposed in the coolant reservoir such that in use the at least one evaporator is disposed in the water coolant in the coolant reservoir, and wherein the at least one evaporator at least partially surrounds the upper region of the space for cooling goods.

18. The cooling device of claim 17, wherein the evaporator is arranged to freeze the water coolant starting from a lower region of the coolant reservoir towards an upper region of the coolant reservoir.

19. The cooling device of claim 17, wherein the upper region of the space for cooling goods that is at least partially surrounded by the coolant reservoir corresponds to 40% to 60% of a height of the space for cooling goods.

20. The cooling device of claim 17, wherein the coolant reservoir is an upwardly open coolant reservoir.

21. The cooling device of claim 17, wherein the space for cooling goods is an air-filled space for cooling goods.

* * * * *